US005203808A

United States Patent [19]

Ide

[11] Patent Number: 5,203,808

[45] Date of Patent: * Apr. 20, 1993

[54] WATER BED WITH COMPACT BUILT-IN DRAIN PUMP

[76] Inventor: Russell D. Ide, 122 Ridge Dr., Exeter, R.I. 02822

[ * ] Notice: The portion of the term of this patent subsequent to Aug. 11, 2009 has been disclaimed.

[21] Appl. No.: 881,506

[22] Filed: May 11, 1992

Related U.S. Application Data

[63] Continuation-in-part of Ser. No. 818,264, Jan. 8, 1992, Pat. No. 5,136,739.

[51] Int. Cl.[5] ..... A47C 27/08

[52] U.S. Cl. ..... 5/451; 5/918; 141/65; 417/151; 417/181

[58] Field of Search ..... 5/450–455, 5/918; 141/65; 417/151, 181

[56] References Cited

U.S. PATENT DOCUMENTS

| | | | |
|---|---|---|---|
| 92,313 | 7/1869 | Hughes | 417/198 |
| 857,920 | 6/1907 | Boekel | 417/198 |
| 995,969 | 6/1911 | Junk | 417/198 |
| 1,040,641 | 10/1912 | Coyle | 417/198 |
| 3,456,270 | 7/1969 | Weinstein et al. | 5/451 |
| 3,748,669 | 7/1973 | Warner | 5/450 |
| 3,766,579 | 10/1973 | Shields | 5/451 |
| 3,879,776 | 4/1975 | Solen | 5/451 |
| 3,999,235 | 12/1976 | Mollura | 5/451 |
| 4,109,333 | 8/1978 | Zmiarovich | 5/451 |
| 4,114,215 | 9/1978 | Santo | 5/451 |
| 4,332,044 | 6/1982 | Houk, Jr. | 5/451 |
| 4,370,769 | 2/1983 | Herzig et al. | 5/452 |
| 4,389,742 | 6/1983 | DeWitt | 5/455 |
| 4,727,607 | 3/1988 | Nystad | 5/450 |
| 4,810,170 | 3/1989 | Ide | 417/198 |
| 5,090,075 | 2/1992 | Larson | 5/918 |
| 5,136,739 | 8/1992 | Ide | 5/918 |

*Primary Examiner*—Alexander Grosz
*Attorney, Agent, or Firm*—Marks & Murase

[57] ABSTRACT

A water bed having a built-in drain pipe. The water bed includes a water tight bladder penetrated by a pump assembly connected to the bladder by a bell shaped insert. The pump assembly includes an inlet port and an outlet port and a jet pump connected between the inlet port and the outlet port. The contents of the water tight bladder can be sucked out by providing a motive liquid at the inlet port and attaching drain tubing at the outlet port. The jet pump includes a jet nozzle and a diffuser aligned with the jet nozzle. A filter may be provided to allow filtering of fluid drawn into the diffuser. The jet pump and fluid passages leading into and out of the pump can be formed as a single piece.

19 Claims, 5 Drawing Sheets

WATER BED WITH COMPACT BUILT-IN DRAIN PUMP

This application is a continuation-in-part of U.S. patent application Ser. No. 07/818,264 filed Jan. 8, 1992, now U.S. Pat. No. 5,136,739.

BACKGROUND OF THE INVENTION

A water bed is simply a water filled bladder that is used as a mattress. The bladder is sometimes filled with fiber or fitted with internal channels to improve comfort. Otherwise, the interior of the mattress can be empty. Examples of known water bed assemblies are shown in U.S. Pat. No. 3,748,669 to Warner and U.S. Pat. No. 3,999,235 to Mollura.

Waterbeds must be drained in order to be moved, relocated or repaired. Typically, the water-tight bladder is fitted with one or more valves through which water is added to fill the bladder or pumped out to drain the bladder. The conventional valve is simply a threaded neck of the type shown in the Warner patent which may be capped. Currently, draining is performed through the use of an external pump that is fitted to an adapter threaded to a valve that is permanently installed in the bed. The adapter is used to convert the valve thread to a garden hose thread and to provide a swivel for ease of hose attachment. An example of such an adapter is shown in U.S. Pat. No. 4,212,335 to Bova.

FIG. 1 shows a conventional water bed mattress. The water bed mattress includes a water tight bladder 5 having a water tight interior area 50 which may be filled with water so that the bladder may be used as a mattress. As mentioned above, the bladder 5 is sometimes filled with fiber or fitted with internal channels to improve comfort, but for simplicity these are not shown. The water tight bladder may be formed of any suitable water tight material as is known in the art.

The bladder 5 includes a valve through which water can be added to or pumped from the bladder. As shown in FIG. 1, the valve is typically a neck portion formed with threads 3 or the like. The neck-type fill/drain valve 1 is typically formed separately from the water tight bladder 5 and secured thereto by heat or adhesive. The threads 3 need not be formed directly on the neck; they may be provided by attaching an adaptor or the like to the neck as is known in the prior art.

In FIG. 1 the overall size of the water filled bladder 5 is represented schematically. As is known in the art, the water filled bladder is typically mattress-sized.

In a conventional water bed, an adaptor such as that disclosed in U.S. Pat. No. 4,212,335 to Bova may be fit into an opening or threaded to the valve threads so that a garden-type hose can be attached for filling or draining. When the bladder is being drained, a pump must be used. Typically, either a venturi pump of the type disclosed in the present inventor's previous patent U.S. Pat. No. 4,810,170 or an electric pump is used. In the case of modern fiber filled mattress bladders, an electric pump can be clogged by the fiber fill. Moreover, external pumps are expensive and must be rented by the customer. Accordingly, in at least these cases, a venturi pump is preferred.

The use of venturi action for causing suction by the passage of fluid through nozzles is well known and documented. A venturi pump typically includes a water supply pipe, and an outlet pipe which is in line with the inlet pipe. Variations of this basic construction are disclosed in the present inventor's previous patent as well as in U.S. Pat. No. 857,920 to Boekel and U.S. Pat. No. 995,969 to Junk.

While venturi pumps offer advantages as a water bed draining pump, known venturi pump constructions are difficult to use with a water bed. Among other things, known venturi pumps are difficult to connect to water beds and must be stored when not in use. These inconveniences have adversely affected the acceptance of venturi pumps for use as water bed drain pumps. Currently the water bed industry is striving to make water beds more user friendly. Accordingly, a premium is placed on user convenience. For these reasons, a water bed with an easy to use venturi pump would be desirable.

The present inventor's previous patent application Ser. No. 07/818,764 filed Jan. 8, 1992, now U.S. Pat. No. 5,136,739 addressed many of these problems by providing a water bed with a built-in drain pump. The pump of that application was preferably a venturi pump that works on the principle that different flow velocities produce different amounts of suction. The bed is fitted with two distinct connections instead of the current one. The second connection remains capped during filling. For draining, however, hoses are attached to both connections. One hose provides a supply of pressurized fluid to the venturi and the second connection allows fluids to discharge.

The bed includes a water-tight bladder having a water tight interior. An inlet port or valve is provided to allow fluid to flow into the interior of the water tight bladder. An outlet port or valve is provided to allow fluid to flow out of the port or valve. A fluid inlet pipe extends into the interior of the water tight bladder from the inlet port. A fluid outlet pipe extends into the interior of the water tight bladder from the outlet port. The distal ends of the inlet and outlet pipes are preferably coaxially aligned. A nozzle is provided in the end of the inlet pipe and a diffuser is formed in the end of the outlet pipe. The nozzle and diffuser are maintained in alignment by a spacer member provided in the interior of the water tight bladder. The spacer member may be of any convenient form, but is preferably formed with openings or elongated slots such that spacer member acts as a filter to prevent clogging of the fluid passages. A filter mesh may be provided to enhance this effect. The venturi pump may be formed as a one-piece element adapted to be inserted into either the outlet pipe or, preferably, the inlet pipe.

The invention described in the previous application is particularly well suited for retrofitting existing bed valves and adapters with an in-bed pump. There remains a need, however, to reduce cost and provide a more compact unit.

SUMMARY OF THE INVENTION

The present invention is directed to satisfying the need for an even more inexpensive and compact in-bed drain pump unit of the type disclosed in my previous application. Although the basic construction is similar to that disclosed in my previous application, the present invention is particularly well suited to original equipment applications a opposed to retrofit applications. The present invention offers a number of advantages when used in such applications. Specifically, the pump of the present invention can be assembled into the mattress with only a single penetration. The design uses one modified valve. The valve is slightly larger with two threaded hose connections. One connection is a female swivel and the second is a male garden hose. Both connections are preferably provided inside a bell shaped insert similar to the existing unit. The pump assembly of the present invention eliminates the need for swivel-type adapters by providing a swivel connection at one end.

The assembly of the present invention is quite compact. In particular, it is estimated that to accommodate the built-in pump, the inside bell-shaped diameter would be approximately 2.5 inches. This is just slightly greater than the current 2.2 inch bell diameter for valves alone. The inside bed pump unit would have a diameter of approximately 1.25 inches and a length of about 2.25 inches. An acceptable female swivel and male hose connections are possible because of the pump support capability.

The overall assembly can be injection molded at a very low cost once the injection molding tooling has been manufactured.

Like the invention described in my previous application, the pump of the present invention is preferably a venturi pump that works on the principle that different flow of velocities produce different amounts of suction. In this case, however, the bed is fitted with one slightly oversized mattress penetration or insert having two distinct connections instead of two distinct inserts as in the present inventor's previous application. One of the two distinct connections formed in the single pump body remains capped during filling. For draining, however, hoses are attached to both connections. One hose provides a supply of pressurized fluid to the venturi and the second connection allows fluid to discharge.

The bed includes a water-tight bladder having a water tight interior. A single bell-shaped valve or mattress insert is provided to support the pump body. The pump body includes an inlet port and an outlet port or a valve to allow fluid to flow into and out of the mattress interior. A fluid inlet pipe extends through the pump body into the interior of the water-tight bladder from the inlet port. A fluid outlet pipe extends into the interior of the water-tight bladder from the outlet port. The body includes a nozzle and a diffuser. The nozzle and diffuser are coaxially aligned such that the venturi pump is a one-piece member.

By virtue of this construction, when a motive fluid is passed into the end of the inlet port, the motive fluid and the fluid in the water tight bladder are caused to flow out of the outlet end of the bladder. If desired, a filter may be provided to filter fluid being drawn out of the mattress.

DETAILED DESCRIPTION OF THE DRAWINGS

As noted earlier, the present invention is a modification of the invention described in the present inventor's earlier application. Thus, the present invention includes the previous invention which will be described first.

Figure 2:
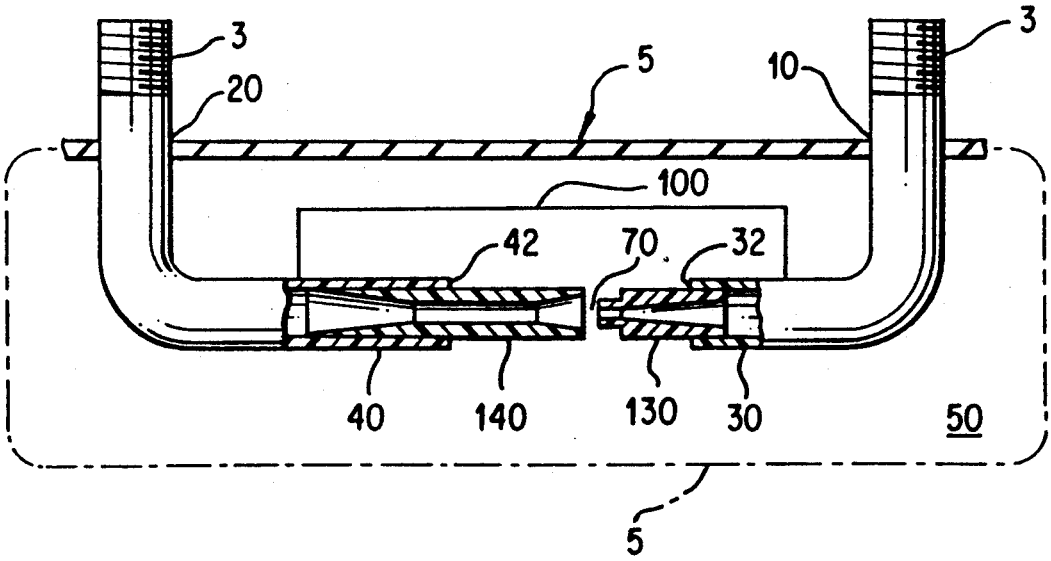
FIG. 2 is a partially schematic view of a water bed mattress according to the present invention showing a detailed view, partially in section, of a built-in drain pump according to the present invention.

FIG. 2 shows, somewhat schematically, the water bed construction of the present invention. The water bed mattress includes a water tight bladder 5 having a water tight interior 50. The body of the water tight bladder is, again, schematically depicted and would actually be much larger in relation to the other components.

Figure 1:
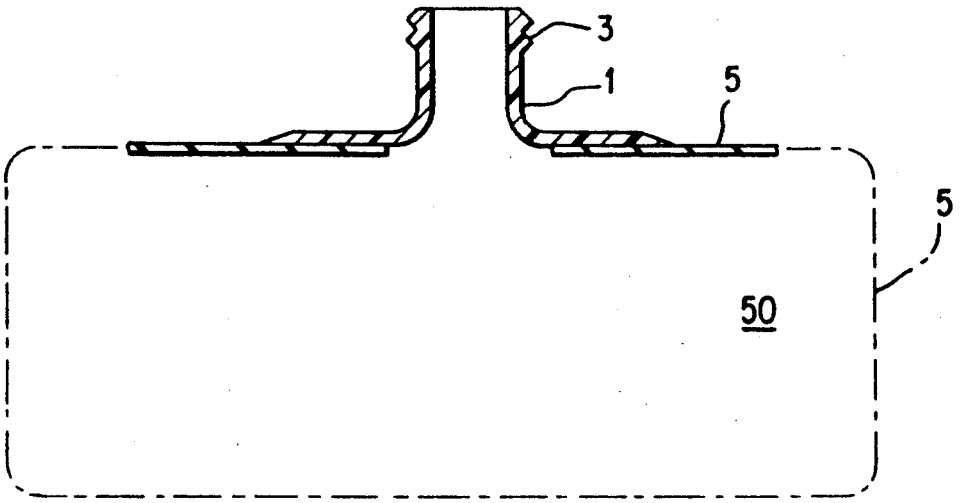
FIG. 1 PRIOR ART
FIG. 1 is a schematic representation of a prior art water bed mattress showing the details, in section, of the valve for filling and draining the mattress.

Unlike the conventional mattress shown in FIG. 1 the mattress of the present invention includes two openings into the water tight bladder — an inlet port 10 and an outlet port 20. A connection or valve is formed at each port. The valves may have a thread 3 formed at their ends so that a cap (not shown) can be secured to the valve to prevent flow through the valve. The threads also allow attachment of a garden hose (not shown) either directly or through an adaptor to allow filling and draining as described below. A typical adaptor is illustrated at 13 in FIGS. 5 and 7.

As shown in FIG. 2 an inlet pipe 30 extends from the inlet port 10 into the interior 50 of the water tight bladder 5. Similarly, an outlet pipe 40 extends from the outlet port 20 into the interior 50 of the water tight bladder 5. The inlet pipe 30 and the outlet pipe 40 each have a distal end, 32, 42, respectively, which is the end of the pipe 30, 40 spaced from the port 10, 20. The distal ends 32, 42 of the pipes 30, 40 are coaxially aligned as shown in FIG. 2. The ends 32, 42 of the pipes 30, 40 are maintained in alignment by a spacer 100. The spacer 100 may have various constructions some of which are described below. Regardless of the specific construction used, the spacer mechanism must, at a minimum, maintain the alignment and spacing of the ends 32, 42 of the pipes 30, 40.

A jet nozzle 130 is fitted into the inlet pipe 30 and a diffuser 140 is fitted into the outlet pipe 40. The jet nozzle 130 shown is in the form of a tubular member with a central bore that decreases in internal diameter from the point where the fluid enters; this construction leads to increased velocity and decreased pressure of the fluid in a known manner.

The inner opening of the diffuser tube 140 is in line with the outlet of the jet 130 with a space 70 between them as illustrated. Because of the decreased pressure of the fluid exiting the nozzle 130, a low pressure, high suction vacuum region is created at the space 70. The diffuser is formed with a passageway which is outwardly flared at both ends and at the outer end thereof is located within the outlet pipe 40 so that fluid passing through the outlet end can be carried away to a suitable outlet source.

Because a vacuum is present in the region 70 between the end of the jet and the beginning of the diffuser 140 water is drawn from the interior 50 of the bladder through the diffuser 140 and out of the water tight bladder 5 via the outlet port 20. The amount of fluid passing through the diffuser is significantly greater than the amount of fluid exiting the jet nozzle such that the interior of the bladder is drained. The diffuser 140 converts the velocity head of the fluid exiting the jet nozzle into a pumping head to pump the fluid out of the bladder. The pump as described above operates in accordance with known venturi principles.

If desired, a ball valve or other mechanism for increasing turbulence so as to increase the suction force as described in the present inventor's previous U.S. Pat. No. 4,810,170 could be employed. This is not, however, believed necessary.

As noted above, the spacer mechanism 100 must space the jet nozzle 130 from the diffuser 140 to obtain optimum suction at the vacuum region 70. There are various possible constructions for the spacer mechanisms. The simplest construction is a metal bar schematically indicated in FIG. 2 which rigidly holds the inlet 30 and outlet 40 pipes in place.

Figure 3:
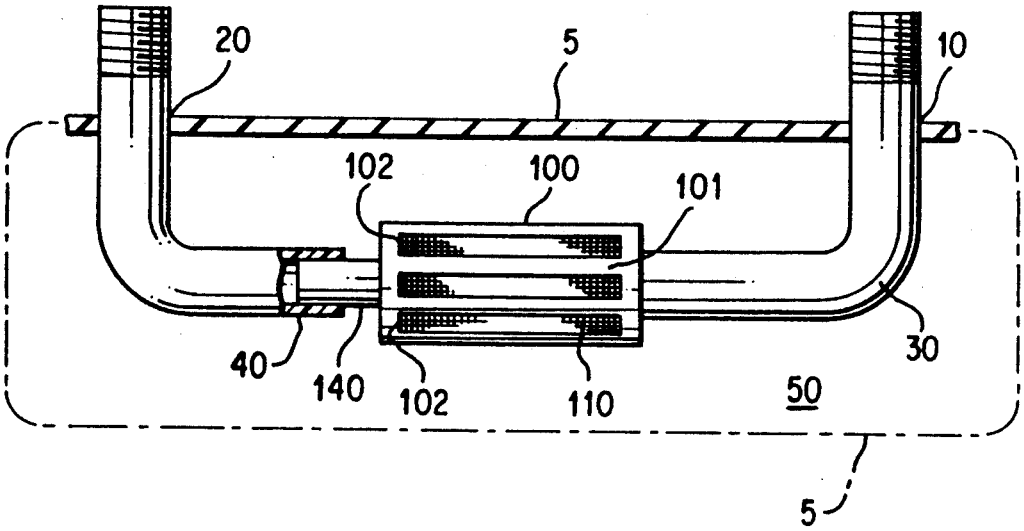
FIG. 3 is a partially schematic view of the water bed mattress of the present invention showing the details of one embodiment of a spacer mechanism according to the present invention.

FIG. 3 shows a water bed construction similar to that of FIG. 2 except that the details of the construction of one embodiment of a spacer mechanism 100 according to the present invention are illustrated. In this case, the spacer mechanism is a chamber-like body 100 having a series of elongated openings 102 formed in the wall to allow fluid to be sucked into the chamber of the spacer 100. The elongated slots 102 are separated by elongated wall portions 101. When the jet pump is operating, fluid is sucked from the interior 50 of the water tight bladder 5 through the openings 102 and into the outlet pipe 40 and subsequently through outlet port 20 out of the water tight bladder 5. If desired, the spacer 100 may include a filter for filtering any particulate matter such as the fiber or filler in the mattress. To some extent, the elongated wall members 101 form a grill which serves to filter very large pieces. If it is necessary to filter smaller pieces, a filter mesh or other type filter such as that illustrated at 110 may be provided over the elongated openings 102 for such a purpose.

Figure 4:
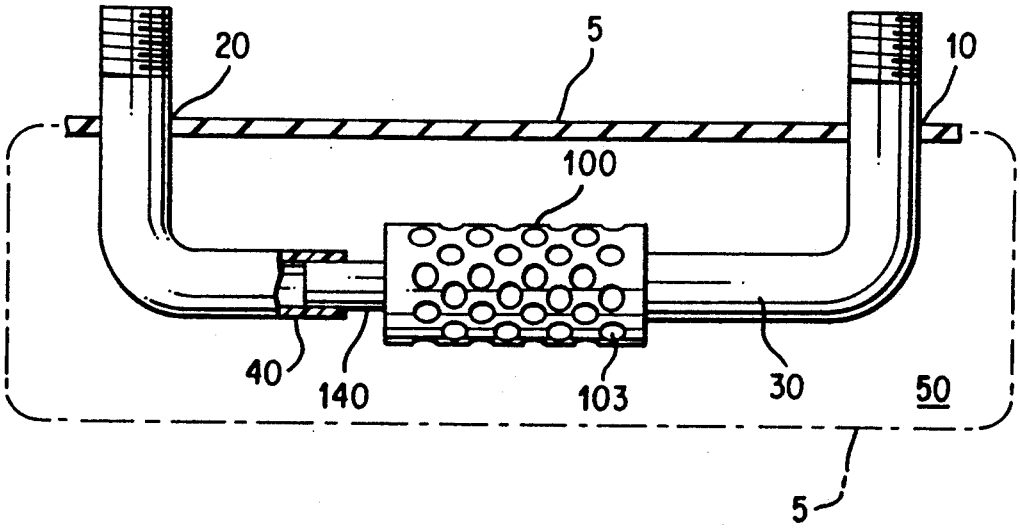
FIG. 4 is a partially schematic view of the water bed mattress of the present invention showing the details of another spacer mechanism according to the present invention.

FIG. 4 shows a water bed construction similar to that of FIG. 3 with a different spacer member 100. In this case, the spacer member 100 is formed as a chamber, but includes a spaced series of openings 103 which allow water to be sucked from the interior 50 of the water tight bladder 5 into the chamber 100 of the spacer and subsequently through the outlet pipe 40 and outlet port 20 to the exterior of the water tight bladder 5. The spaced series of openings act as a filter for large pieces of material. Again, if desired, a smaller filter mesh may be used to filter smaller pieces.

The venturi pump can be formed as a single one-piece member adapted to be inserted into either the outlet port or, preferably, the inlet port. Such a construction offers several advantages. One advantage is that the pump assembly can be easily removed from the interior of the mattress. Another advantage is that the number of parts is decreased. This simplifies assembly and can reduce manufacturing costs.

FIGS. 5, 6A, 6B and 7 illustrate an embodiment using a one-piece pump. In the illustrated embodiment, the one-piece pump 200 is adapted to be located in the inlet port 10 rather than the outlet port 20. Alternatively, the one-piece pump 200 can be designed for insertion into the outlet end by simply flipping the position of the diffuser and the jet nozzle portions.

Figure 5:
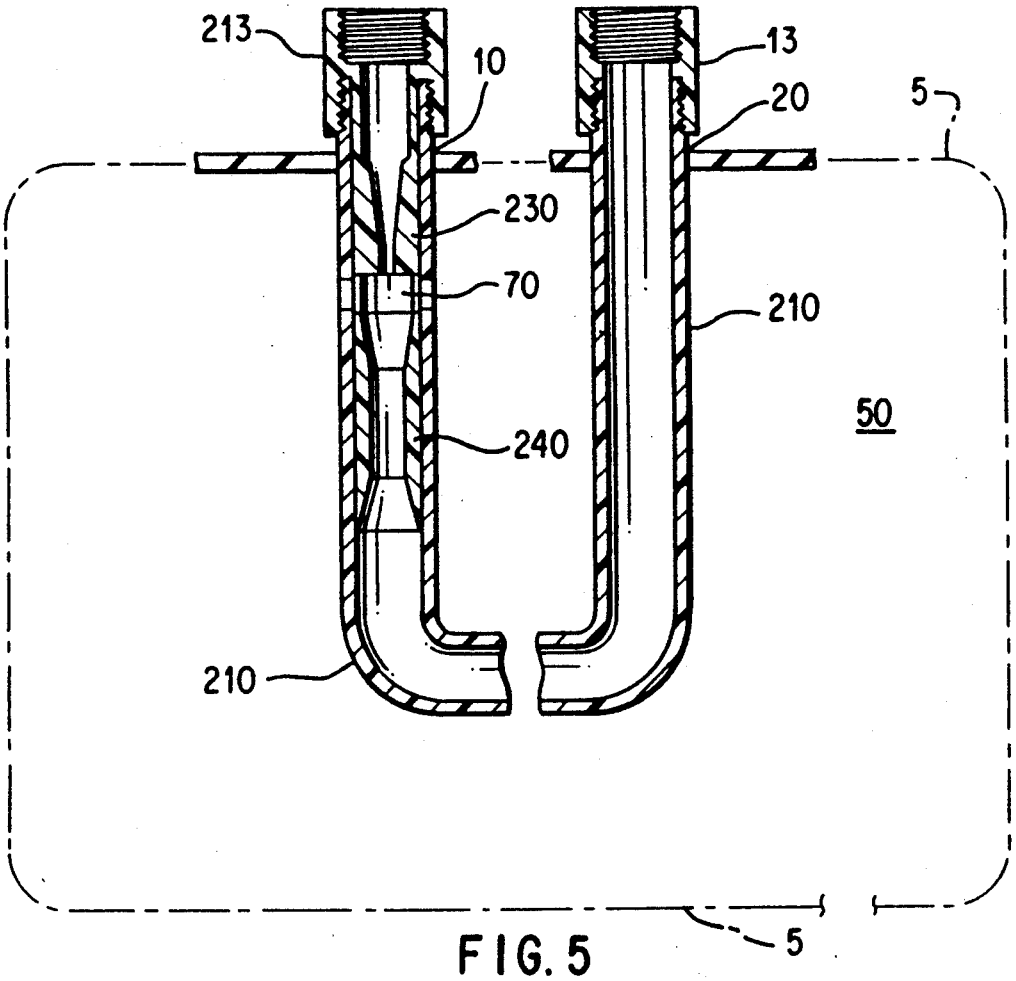
FIG. 5 is a partially schematic cross-sectional view of the water bed of the present invention with a different form of venturi pump.

As shown in FIG. 5, the water bed of this embodiment includes a water-tight mattress 5 having a water-tight interior 50. Again, the mattress includes two openings into the water-tight bladder — an inlet port 10 and an outlet port 20. A connection or valve is formed at each port and each connection is formed with threads 203. At the outlet end, an adaptor 13 is screwed on to the threads 203. The adaptor 13 is a conventional adaptor which allows a conventional garden hose to be threaded into the adaptor 13 such that the garden hose can be coupled to the outlet connection.

A fluid pipe 210 extends between the outlet port and the inlet port. The fluid pipe 210 can be of conventional construction except that it should, preferably, extend straight from the port into which the one-piece venturi pump will be inserted for reasons which will become obvious below. The pipe 210 should also include openings 206 which are positioned so as to align with the openings 205 in the venturi pump described below.

Figure 6A:
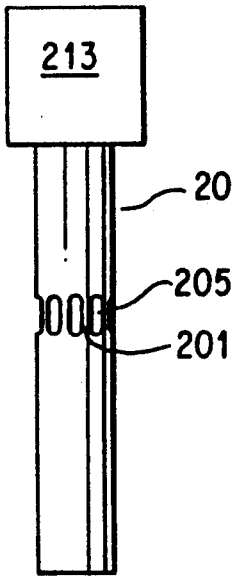
FIG. 6A is a side view of the one-piece venturi pump insert used in the embodiment of FIG. 5.
Figure 7:
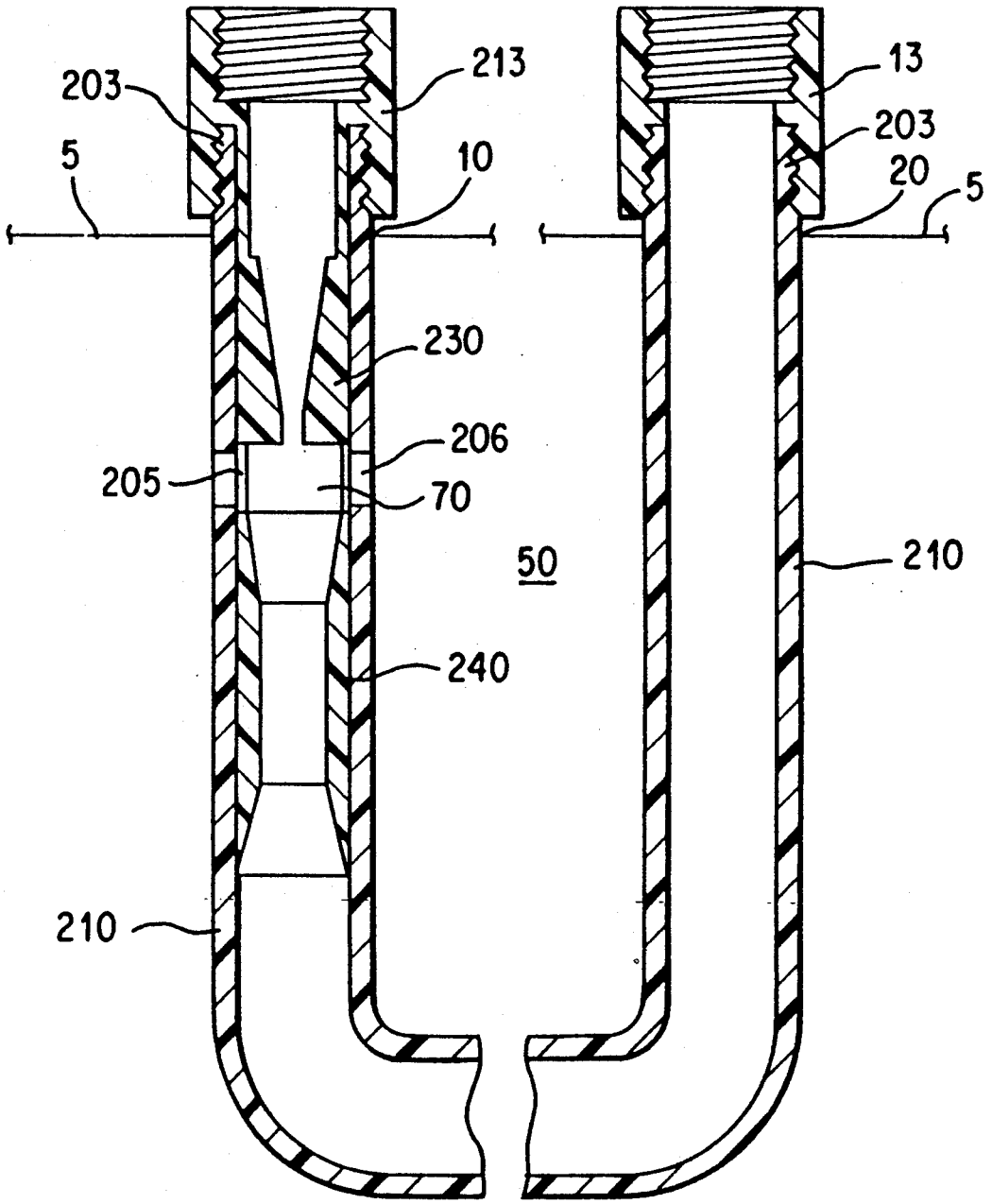
FIG. 7 is a cross-sectional detail view of the portion of the embodiment of FIG. 5 which includes the pump.

The venturi pump 200 includes an adaptor head 213 which is adapted to be screwed on to the threads 203 formed on the inlet connection. As best shown in FIG. 7, the adaptor head 213 includes an additional set of internal threads to allow a garden hose or similar tubing to be threaded into the adaptor head 213. As best shown in FIGS. 5 and 7, the venturi pump 200 includes a pump portion which is adapted to be inserted into the straight portion of the fluid pipe 210. The pump portion includes a jet nozzle portion 230, a diffuser portion 240 and, as best shown in FIG. 6A, thin spacer ligaments 201 for connecting the jet nozzle portion 230 to the diffuser portion 240 so as to maintain alignment of these two portions. The ligaments 201 are separated from one another by a series of spaced openings 205 which act as suction openings in the manner described above.

The operation of the one-piece venturi pump 200 is the same as the previously described venturi pump. The jet nozzle portion 230 functions in the same manner as the jet nozzle 130 of FIG. 2. Likewise, the diffuser portion 240 functions in the same manner as the diffuser 140 of FIG. 2. The ligaments 201 perform the function of the spacer member 100 of FIG. 2. The fluid tube 210 acts as both an inlet pipe and an outlet pipe. Thus, when fluid is caused to flow into the inlet port, a low pressure, high suction vacuum region is created at the space 70. As a result, fluid is drawn from the interior 50 of the mattress out of the outlet port.

Figure 6B:
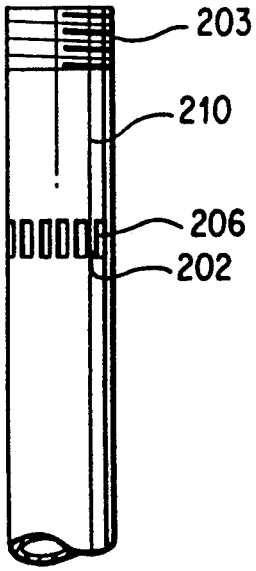
FIG. 6B is a side view of a portion of the fluid pipe used in the embodiment of FIG. 5.

As best shown in FIG. 6A and 6B, the openings 205 formed in a side wall of the pump member 200 are positioned so as to be aligned with the openings 206 formed in the fluid pipe 210 when the pump 200 is fully inserted into the pipe 210. When the openings 205, 206 are aligned they act in the same manner as the elongated slots 102 in the embodiment of FIG. 3. In particular, they allow fluid to be sucked from the interior 50 of the water-tight bladder 5 into the diffuser portion 240.

As discussed above with the embodiments of FIGS. 3 and 4, the openings 205, 206 provide some degree of filtering. If desired, a filter mesh or other type filter may be provided over the openings to enhance filtering.

The embodiments disclosed in FIGS. 1–7, and discussed above, were previously disclosed in the present inventor's U.S. patent application Ser. No. 07/818,264 filed on Jan. 8, 1992 now U.S. Pat. No. 5,136,739. The present invention includes these embodiments but provides certain modifications which are all suited for certain applications or simplifying manufacture of the present invention. These modifications will be described hereinafter with reference to FIGS. 8, 8A, 9 and 9A.

The modifications described herein are principally directed toward further simplifying the construction of the built-in drain pump; providing a built-in drain pump which can be installed with a single penetration into the water tight mattress; and eliminating the need for a swivel connector or adaptor.

Figure 8A:
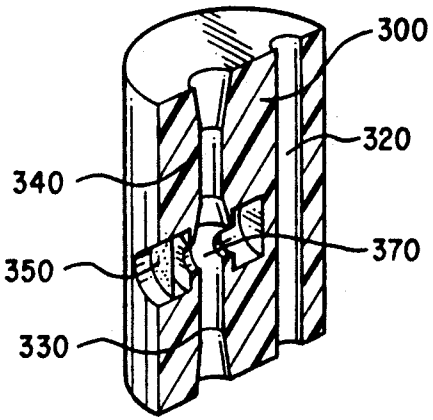
FIG. 8A is a perspective view of a portion of the pump body of the embodiment of FIG. 8.
Figure 8:
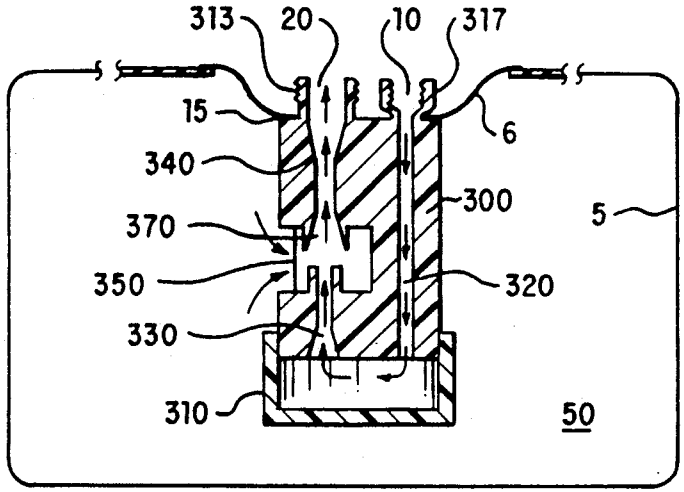
FIG. 8 is a partially schematic cross-sectional view of the water bed with a compact built-in pump according to the present invention.

As shown in FIG. 8, the water bed includes a water-tight mattress 5 having a water tight interior 50. A single bell shaped insert 6 penetrates the water tight mattress 5 and is connected to a pump body 300. The pump body includes two threaded hose connections 313, 317. One connection 317 is a female swivel and the second connection 313 is a male garden hose connection. The provision of the female swivel 317 obviates the need for a separate swivel adaptor. Both the male 313 and the female 317 connections are provided within the bell shape of the bell insert 6 as shown. As shown in FIG. 8, the male garden hose type connection 313 is preferably integrally formed with the pump body 300 to simplify the assembly and reduce cost.

As can be appreciated from the partial perspective view shown in FIG. 8A, the pump body is designed as a single piece which includes many of the components of the drain pump of the present invention. The piece is adapted to be injection molded. To facilitate such injection molding, the pump body 300 may be formed in semi-cylindrical halves or sections similar to that shown in FIG. 8A. The sections then may be glued or otherwise secured together and held in place within the outer cap 310.

The pump body 300 includes a cylindrical inlet passage 320, a jet nozzle portion 330 and a diffuser portion 340. The cap 310 closes one end of the pump body 300 so that fluid leaving the cylindrical passage 320 is directed into the diffuser portion 330. If desired, a filter mesh or some other type of filter 350 may be provided in the opening 370 between the diffuser and the jet nozzle portions.

In accordance with another aspect of the present invention, an opening 370 is provided in the pump body so as to provide a base for the low pressure, high suction vacuum region. As shown in both FIGS. 8 and 8A, the space 370 is open to the interior 50 of the water tight mattress 5 such that fluid can flow into the interior 50 of the mattress from the pump body during filling and be drawn from the interior 50 through the opening 370 during draining. As mentioned before, a filter mesh or the like may be provided in the opening 370 to filter particulate matter such as pieces of synthetic foam which is sometimes provided inside the mattress.

Figure 9A:
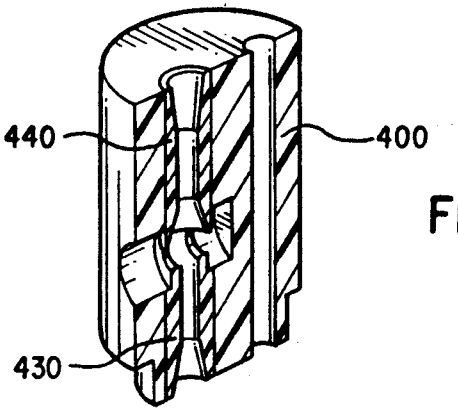
FIG. 9A is a perspective view of a portion of the pump body of the embodiment of FIG. 9.
Figure 9:
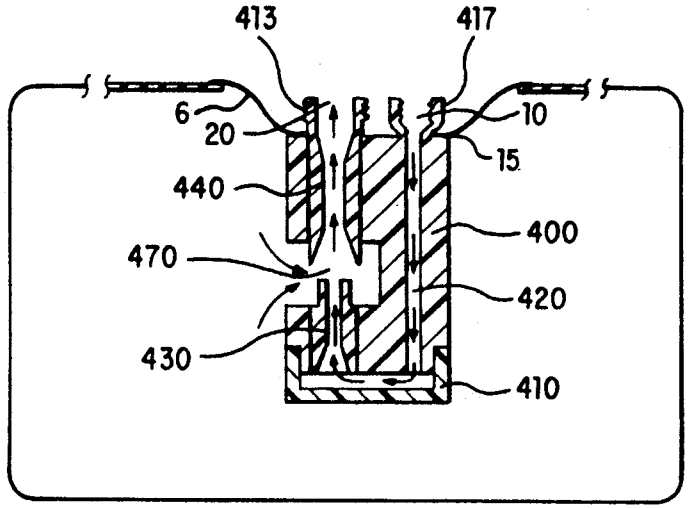
FIG. 9 is a partially schematic cross-sectional view of a water bed with another compact built-in pump according to the present invention.

FIGS. 9 and 9A show an embodiment similar to that of FIG. 8, but slightly modified to further facilitate injection molding. Specifically, in this embodiment, like the embodiment of FIGS. 8 and 8A, a single penetration is provided. The penetration is embodied by a bell shaped insert 6 which is connected to a pump body 400. The pump body includes a cylindrical inlet passage 420, a jet nozzle 430 and a diffuser 440. In this case, however, the jet nozzle 430 and diffuser 440 are formed separately from the main piece of the pump body. This allows the pump body to be molded as a simple body member with the more complex diffuser and jet nozzle components being separately molded and inserted into the main body. The jet nozzle 430 and diffuser 440 may be molded as a single piece or molded separately and inserted into the pump body. Again, a cap 410 is provided to close one end of the pump body and direct fluid passing through the cylindrical inlet passage 420 into the jet nozzle. In this case, the cap 410 abuts on a reduced end of the pump body 400. With the exception of the previously mentioned differences which might be desirable for certain manufacturing conditions, the pump assembly shown in FIGS. 9 and **9*a* is essentially identical to that of FIGS. 8 and 8A**.

The manufacturing advantages of the embodiments disclosed in FIGS. 8–9A should be readily understood to those skilled in the art. Pump body components can be made by simple injection molding. Provision of a female swivel eliminates the need for a separate adaptor and the entire assembly can be installed with a single penetration in the mattress, thus simplifying manufacture. Thus, the present invention provides a compact, inexpensive, convenient alternative to conventional water bed filling and draining assemblies and procedures.

It can be seen from the foregoing description that the water bed of the present invention includes a built-in venturi type drain pump. The bed is fitted with two distinct cap-type valves instead of the conventional one. In operation, the second valve or outlet port is capped to allow filling. For draining, hoses are attached to both connections and the inlet hose provides a supply of motive fluid to the venturi and the second hose discharges fluids.

What is claimed is:

1. A water bed having a built-in drain pump, the water bed comprising:

a water tight bladder having a sealed interior;

an insert, the insert having an outer periphery connected to the bladder and an opening into the interior of the bladder;

a pump extending into the water tight bladder through the opening, the pump including: a pump body having an inlet port formed in the pump body to allow fluid to pass into the interior of the water tight bladder, an outlet port formed in the pump body to allow fluid to flow out of the water tight bladder, an inlet pipe extending from the inlet port into the interior of the water-tight bladder;

an outlet pipe extending from the outlet port into the interior of the water tight bladder;

a jet nozzle formed in the pump body, the jet nozzle having an inlet opening and a discharge opening, the inlet opening being in fluid communication with the inlet pipe so that fluid passing through the inlet pipe is directed into the inlet opening of the jet nozzle, the inlet opening being larger than the discharge opening such that the velocity of fluid passing through the nozzle is increased; and a diffuser formed in the pump body, the diffuser having an inlet opening and an outlet opening, the inlet opening of the diffuser being larger than the outlet opening of the jet nozzle and the outlet opening being connected to the outlet pipe, the discharge end of the jet nozzle being coaxially aligned with the inlet end of the diffuser and spaced therefrom whereby when fluid is caused to flow through the jet nozzle, a suction pressure is created.

2. The water bed of claim 1, wherein both the inlet port and outlet port have threaded couplings for attachment to fluid conducting tubing and one of the threaded couplings is a swivel coupling.

3. The water bed of claim 1, wherein a filter for filtering fluid drawn into the diffuser is provided in the pump body.

4. The water bed of the claim 1, wherein the insert is a bell shaped insert which is recessed into the water tight bladder.

5. The water bed of claim 1, wherein the jet nozzle and diffuser are formed as a one-piece pump element.

6. The water bed of claim 1, wherein the inlet pipe, the outlet pipe, the jet nozzle, and the diffuser are integrally formed as a single piece.

7. A water bed with a built-in drain pump, the water bed comprising: a water tight bladder having a water tight interior; a pump assembly extending into the interior of the bladder, the pump assembly including a pump body having: an inlet port formed in the pump body; an outlet port formed in the pump body; a jet pump formed in the pump body between the inlet port and the outlet port and means for directing fluid from said inlet port through said jet pump and out of said outlet port, whereby when a motive fluid is passed into the inlet end of the inlet port, the motive fluid and the fluid in the water tight bladder are caused to flow out of the outlet end of the bladder, the jet pump comprising: a jet nozzle, the jet nozzle having an inlet end and a discharge end, a diffuser having an inlet end and an outlet end, the outlet end being in fluid communication with the outlet port; the jet nozzle and diffuser being aligned and constructed such that fluid exiting through the jet nozzle creates a suction at the entrance to the diffuser whereby fluid is drained from the interior of the water tight bladder.

8. The water bed of claim 7, wherein filter means are provided in the pump body for filtering fluid drawn from the interior of the bladder.

9. The water bed of claim 7, wherein the inlet port has a threaded female swivel coupling for attachment to a supply of motive liquid.

10. The water bed of claim 7, wherein the pump assembly is connected to a bell shaped insert which penetrates the water tight bladder.

11. The water bed of claim 7, wherein the jet nozzle and diffuser are formed as a one-piece pump element.

12. The water bed of claim 7, wherein the means for directing fluid includes an inlet pipe and an outlet pipe formed in the pump body, and a pump body end cap for directing fluid into the jet nozzle.

13. A water bed with a built-in drain pump, the water bed comprising: a water tight bladder having a water tight interior, a pump assembly connected to and penetrating into the water tight interior of the bladder through a single opening in the bladder, the pump assembly comprising an inlet port and an outlet port formed therein to allow fluid to pass into and out of the interior of the water tight bladder and a jet pump connected between the inlet and the outlet port such that when motive fluid is caused to flow through the inlet port, a suction force is created within the interior of the water tight bladder such that the contents of the water tight bladder are drained through the outlet port.

14. The water bed of claim 13, wherein the jet pump comprises: a jet nozzle having an inlet end and a discharge end, the inlet end being in fluid communication with the inlet port; and a diffuser having an inlet end and an outlet end, the discharge end of the jet nozzle being aligned with the inlet end of the diffuser such that fluid exiting the nozzle creates a suction at the inlet end of the diffuser.

15. The water bed of claim 14, further comprising filter means for filtering fluid sucked into the diffuser.

16. The water bed of claim 14, wherein the inlet port has a threaded female swivel coupling for attachment to a supply of motive liquid.

17. The water bed of claim 13, wherein the pump assembly is connected to the water tight bladder via a bell shaped insert.

18. The water bed of claim 14, wherein the jet pump, inlet pipe and outlet pipe are integrally formed.

19. The water bed of claim 14, wherein the jet nozzle and diffuser portion are integrally formed as a single piece.

* * * * *